US005857390A

United States Patent [19]

Whiteford

[11] Patent Number: 5,857,390

[45] **Date of Patent: *Jan. 12, 1999**

[54] REVERSIBLE RATCHET WRENCH INCLUDING THIN-WALLED SOCKETS

[76] Inventor: Carlton L. Whiteford, 3 High Point Rd., Westport, Conn. 06880

[ * ] Notice: This patent issued on a continued prosecution application filed under 37 CFR 1.53(d), and is subject to the twenty year patent term provisions of 35 U.S.C. 154(a)(2).

[21] Appl. No.: 772,929

[22] Filed: Dec. 24, 1996

[51] Int. Cl.[6] ..... B25B 13/46

[52] U.S. Cl. ..... 81/62; 81/124.3; 81/63

[58] Field of Search ..... 81/58, 60, 61, 81/62, 63, 63.1, 63.2, 121.1, 124.3

[56] References Cited

U.S. PATENT DOCUMENTS

| | | | |
|---|---|---|---|
| 1,391,677 | 9/1921 | Foss | 81/62 |
| 1,798,194 | 3/1931 | Dodge | 81/62 |
| 2,107,568 | 2/1938 | Haist | 81/62 |
| 2,570,779 | 10/1951 | Dodge et al. | 81/62 |
| 2,651,230 | 8/1953 | Waterval | 81/185 |
| 2,943,523 | 7/1960 | Gray et al. | 81/62 |
| 3,299,750 | 1/1967 | Campanile et al. | 81/62 |
| 4,631,988 | 12/1986 | Colvin | 81/62 |
| 5,203,240 | 4/1993 | Sorter | 81/63.2 |
| 5,295,422 | 3/1994 | Chow | 81/124.3 |
| 5,365,807 | 11/1994 | Darrah et al. | 81/60 |
| 5,448,930 | 9/1995 | Miner et al. | 81/124.3 |
| 5,584,220 | 12/1996 | Darrah et al. | 81/63 |
| 5,626,062 | 5/1997 | Colvin | 81/63.2 |

FOREIGN PATENT DOCUMENTS

| | | | |
|---|---|---|---|
| 671630 | 12/1929 | France | 81/61 |

OTHER PUBLICATIONS

"Armstrong Reversible Bridge Wrenches," Armstrong Bros. Tool C. catalog, p. 87, 1973.

*Primary Examiner*—Eileen P. Morgan
*Assistant Examiner*—Joni B. Danganan
*Attorney, Agent, or Firm*—Spencer E. Olson

[57] ABSTRACT

A light-weight, low-profile socket wrench system includes a set of cylindrical thin-walled sockets, each having a through axial opening sufficiently large to allow a bolt engaged by a nut of a size corresponding to that of the nut-receiving opening to pass through the axial opening and extend beyond the nut, and a ratchet wrench releasably engageable with the socket for applying rotational torque directly to a peripheral surface of the socket. In a preferred embodiment, the socket has a round peripheral surface around which a multiplicity of teeth are distributed, and the head of the ratchet wrench has a circular cylindrical opening in which the socket is releasably maintained with its teeth directly engaged by teeth on a pawl.

16 Claims, 4 Drawing Sheets

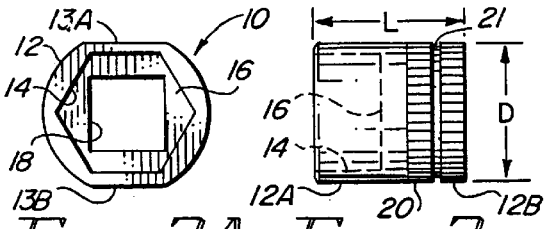
FIG. 2A FIG. 2
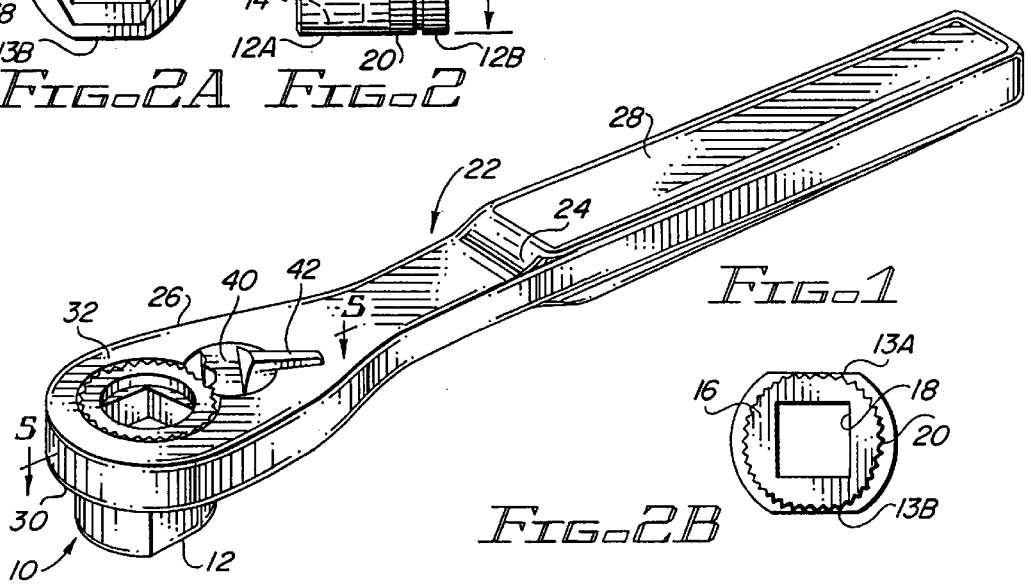
FIG. 1
FIG. 2B
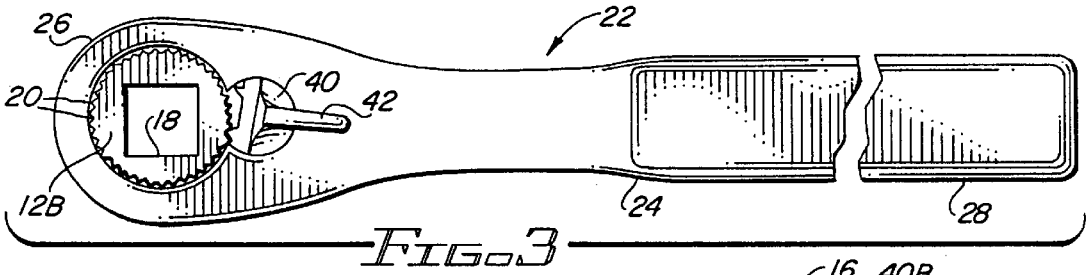
FIG. 3
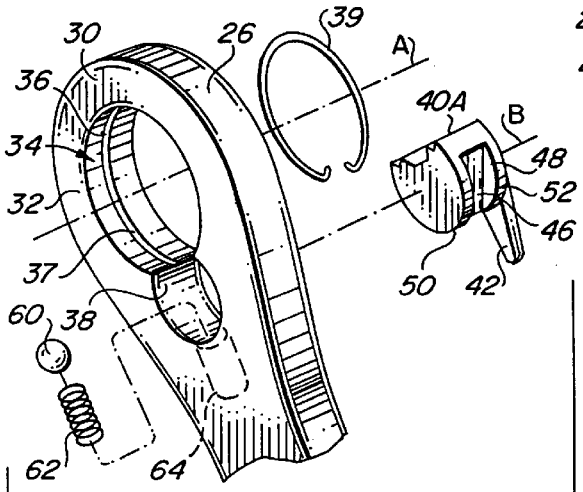
FIG. 4
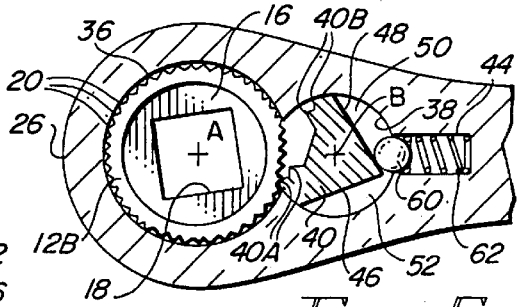
FIG. 5
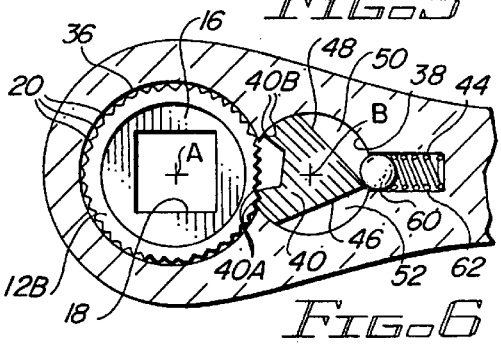
FIG. 6

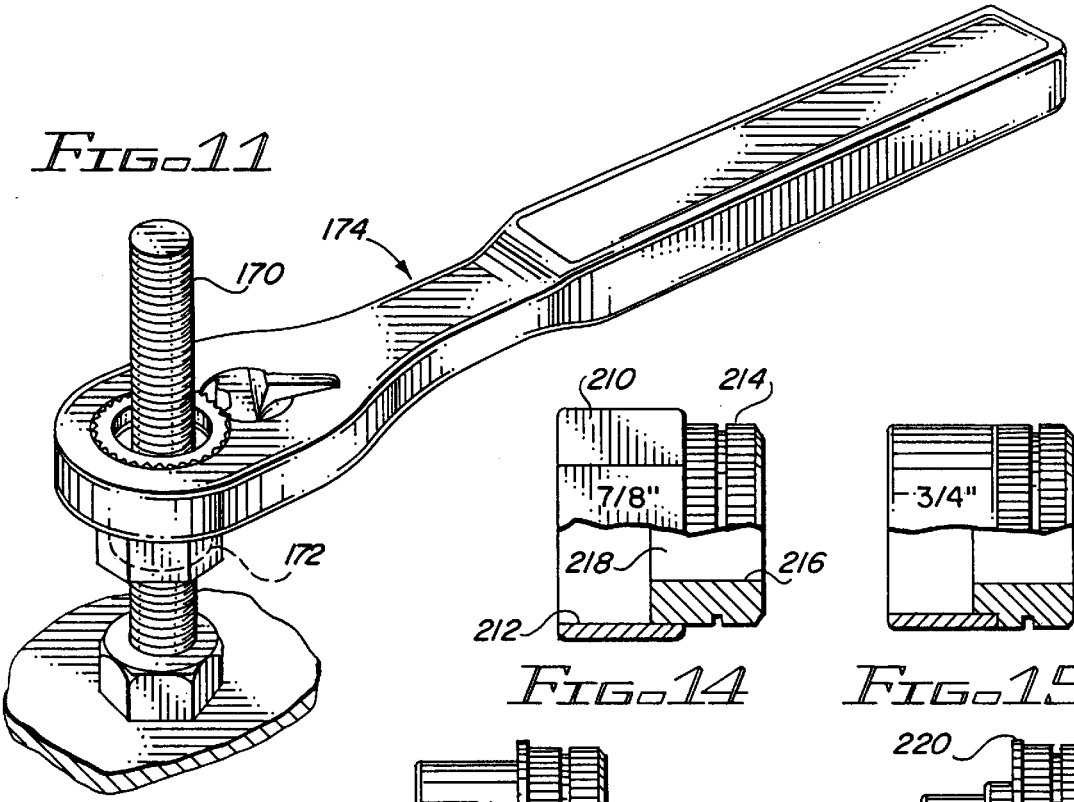
FIG. 11
FIG. 14
FIG. 15
FIG. 16
FIG. 17
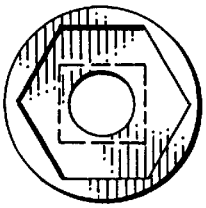
FIG. 12A
(PRIOR ART)
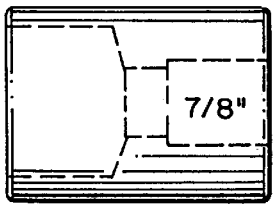
FIG. 12B
(PRIOR ART)
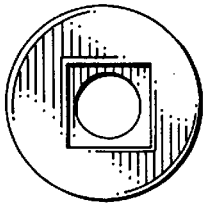
FIG. 12C
(PRIOR ART)
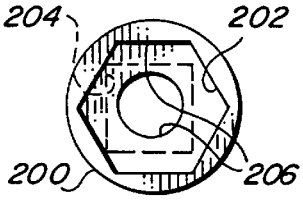
FIG. 12D
(PRIOR ART)
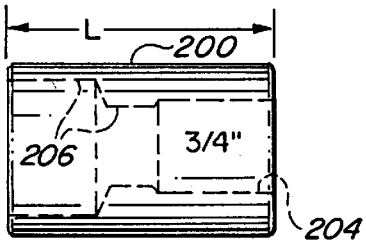
FIG. 12E
(PRIOR ART)
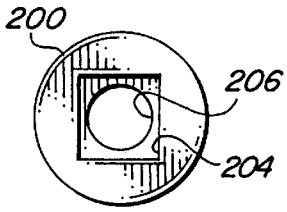
FIG. 12F
(PRIOR ART)

REVERSIBLE RATCHET WRENCH INCLUDING THIN-WALLED SOCKETS

BACKGROUND OF THE INVENTION

This invention relates generally to a reversible ratchet wrench and, more particularly, to a socket wrench system including a thin-walled socket and a ratchet handle which applies torque to an exterior surface of the socket to selectively drive it in opposite directions to either tighten or loosen a nut or bolt head engaged by the socket.

The reversible ratchet wrench, one of the most versatile wrenches in the toolbox, has long been utilized to selectively apply torque in either direction to tighten or loosen a nut or a bolt head. The wrench head conventionally includes a square driving lug that fits into a square drive opening at one end of a socket which at the other end typically has a 6-point hexagonal opening which engages the nut or bolt head. The square driving lug conventionally has a spring-loaded ball that fits into a recess formed in the square socket opening and keeps the socket and drive lug engaged during normal usage; a slight pull on the socket disassembles the connection.

The driving lug is carried on a rotatable toothed driver, and a pawl mounted on the head engages teeth on the driver to prevent rotation of the driver in one direction while permitting rotation in the other direction by a ratcheting operation. Most reversible ratchet wrenches have a reversing lever which operates a pawl disposed inside the head. Moving the lever in one direction causes the pawl to engage teeth on the driver and turn the socket; moving the lever in the opposite direction causes the pawl to slide over the teeth, permitting the handle to back up without moving the socket. This allows rapid turning of a nut or bolt head after each partial turn of the handle. With the reversing lever in one position, it can be used for tightening, and, with the lever in the other position, the handle can be used for loosening.

Conventional sockets are classified by size according to two factors: (1) drive size—the size of the square opening in which the driving lug is received, and (2) size of the nut-receiving opening. A typical toolbox may be outfitted with three sets of sockets respectively having ¼-, ⅜-, and ½-inch square drive openings, and the nut-receiving openings are normally graduated in 1/16-inch increments. Also available in various drive sizes are sockets with deep nut-receiving openings adapted to fit over spark plugs and long bolt ends.

While the above described reversible ratchet wrench has long enjoyed wide acceptance without fundamental changes in construction, it has inherent design limitations which preclude its use in certain situations and contribute to higher than necessary weight and attendant increased manufacturing cost. For purposes of later comparison, a standard 6-point ¾-inch socket with a ⅜-inch drive opening, for example, has a 1-inch outside diameter, an overall length of 1½ inches, the square drive opening extends ⅝-inch inwardly from one end of the socket, the nut-receiving opening extends ½-inch inwardly from the other end, and weighs two ounces. Thus, unless the extension of a bolt beyond the nut is less than ½-inch, the socket could not engage the nut, and a deeper socket would be called for.

Moreover, conventional reversible ratchet wrenches are usually somewhat complex and relatively expensive to machine and thus are relatively expensive to manufacture.

SUMMARY OF THE INVENTION

Accordingly, there is a need for, and it is a primary object of the present invention to provide, an improved reversible ratchet wrench which has an uncomplicated construction so as to be economical to manufacture while still having high strength and being effective in use.

Another object of the invention is to provide an improved socket for a reversible ratchet wrench which is smaller and lighter in weight than a comparably-sized prior art socket so as to require less material to manufacture while still being of equal or greater strength.

Another object of the invention is to provide a socket for a reversible ratchet wrench to which the wrench applies rotational torque to an exterior surface of the socket.

Another object is to provide a reversible wrench wherein the ratchet handle applies rotational torque to an exterior surface of the socket, enabling replacement of the usual square drive opening with an axial opening sufficiently large to allow a bolt engaged by a nut of a size corresponding to the nutreceiving opening to pass through the opening and extend beyond the nut.

Briefly, the reversible ratchet wrench in accordance with the invention includes a ratchet handle and a head having an opening that extends between its opposed faces, and a set of cylindrical sockets graduated according to the size of their typically hexagonal nut-receiving openings, which extend inwardly from one end and are bottomed at an integral transverse wall located approximately mid-length of the socket. Each socket has an axial opening which extends inwardly from its other end and through the transverse wall to connect with the nut-receiving opening, the opening being sufficiently large to allow a bolt engaged by a nut of a size corresponding to the nut-receiving opening to pass through and extend beyond the nut. This axial opening preferably is square and sized to receive a standard-sized driving lug of a conventional prior art ratchet wrench of a size consistent with maximization of the size of the axial opening, but may be circular.

In accordance with an important feature of the invention, rotational torque is directly applied to an external peripheral surface of the socket that extends inwardly from the end opposite the nut-receiving opening; the length of this surface substantially corresponds to the thickness of the head of the ratchet wrench with which the socket is used and is shaped and dimensioned to be engaged by the wrench head opening. In a preferred embodiment, in which the wrench head is ⅜-inch thick and has a ⅞-inch diameter circular opening, the peripheral surface of the socket is round and ⅞-inch in diameter, and has a multiplicity of teeth, typically thirty-six in number, spaced around its periphery. These teeth are adapted to be engaged by a pawl embodied in the ratchet wrench for enabling the application of torque to the socket during use. Because torque is applied externally of the socket there is no need for the usual square lug-receiving opening, allowing its replacement with the aforementioned relatively large axial opening. As a result of the larger axial opening and its connection to the nut-receiving opening the socket is generally hollow and has thin walls, so as to require less material to manufacture while still being of equal or greater strength than prior art sockets of comparable size.

In a second embodiment of the socket, the peripheral surface to which rotational torque is applied is hexagonal in shape and the ratchet wrench for driving it has a circular driver having ratchet teeth and a centrally located hexagonal opening dimensioned to engage the hexagonal peripheral surface of the socket. This embodimemnt of the socket also has an axial opening, which may be circular or square, extending from the bottom of the nut-receiving opening, and sufficiently large to allow a bolt to pass therethrough.

BRIEF DESCRIPTION OF THE DRAWINGS

Other objects, features and advantages of the invention will become apparent, and its construction and operation better understood, from the following detailed description when read conjunction with the accompanying drawings, in which:

FIG. 1 is a perspective view of the preferred embodiment of a reversible ratchet wrench and socket constructed in accordance with the invention;

FIGS. 2, 2A and 2B are side, left end and right end views, respectively, of a socket constructed in accordance with a preferred embodiment of the invention;

FIG. 3 is an view of the wrench;

FIG. 4 is an exploded perspective view that shows the construction of the head of a wrench for use with the socket shown in FIG. 2, 2A and 2B;

FIG. 5 is a sectional view taken along line 5—5 in FIG. 4;

FIG. 6 is a view similar to FIG. 5, illustrating the wrench as ratcheting operation takes place;

FIG. 11 is a perspective view illustrating the operational advantage of the large axial opening in the socket;

FIGS. 12A, 12B and 12C are left end, side and right end views, respectively, of one size of a typical prior art socket;

FIGS. 12D, 12E And 12F are left end, side and right end views, respectively, of another size of a typical prior art socket;

FIGS. 12G, 12H and 121 are left end, side and right end views, respectively, of a third size of a typical prior art socket;

FIGS 14, 15 16 and 17 are partially-sectioned side views that illustrate two-piece constructions for the sockets shown in FIG. 13.

DESCRIPTION OF THE PREFERRED EMBODIMENTS

Figure 7A:
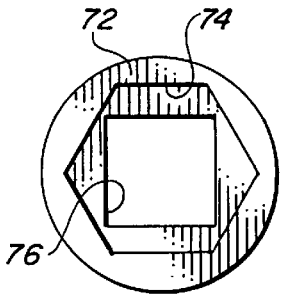
FIGS. 7, 7A and 7B are side, left end and right end views, respectively, of a variation of the socket shown in FIG. 2.

Referring to the drawings, the socket wrench system constructed in accordance with the invention includes a set of sockets graduated according to the size of their nut-receiving openings, and a reversible ratchet wrench for applying manual force to a selected socket during use. FIGS. 2, 2A and 2B are side, left end and right end views of a representative socket 10 of a set, of which four are shown in FIGS. 13A through 13L. The socket consists of a generally cylindrical steel body 12 of given length, L, and includes collinear integrally joined first and second cylindrical body portions 12A and 12B having lengths approximately two-thirds and one-third, respectively, of the overall length of the socket. A 6-point hexagonal nut-receiving opening 14 extends inwardly from the free end of body portion 12A to a depth determined by a relatively thin transverse wall 16. A square axial opening 18 extends inwardly from the free end of body portion 12B through transverse wall 16 to connect with the nut-receiving opening. The outer surface of first body portion 12 is circular cylindrical except for having a pair of diametrically opposed flat surfaces. Alternatively, the outer surface of this portion of the length of the body may be completely round or hexagonal in shape.

The second body portion 12B has a circular cylindrical peripheral surface having a diameter D, around which a multiplicity of teeth 20 of the same length as body portion 12B, typically thirty-six in number, are uniformly distributed. A peripheral groove 21, typically 0.020 inch wide and about half that deep, is located mid-length of the teeth, and serves as a detent which engages a spring "C"-ring in the ratchet wrench (to be described) to maintain the socket and wrench in releasable engagement.

With reference to FIGS. 1 and 3, a reversible ratchet wrench 22 for applying torque to the socket, which is a simplified adaptation of the widely used wrench described in U.S. Pat. No. 4,631,988, entitled "Reversible Ratchet Wrench Including Detent Mechanism", and includes a body 24 having a head 26 and a handle 28 that extends from the head to permit the application of manual force during use of the wrench. The thickness of wrench head 26, defined by its opposing parallel planar surfaces 30 and 32 substantially corresponds to the length of the toothed peripheral surface of the second body portion 12B of socket 10. As best seen in FIGS. 4 through 6, wrench head 26 has an opening 34 extending between its opposing surfaces which includes a circular portion 36 and a circular pawl-receiving portion 38 that intersects and slightly overlaps portion 36. The circular portion 36 has a diameter that corresponds to the diameter D, of the toothed second body portion 12B of socket 10 and has a narrow shallow groove 37 formed in its wall at a location midway between the opposing surfaces of the wrench head. A "C"-shaped spring wire 39, formed of small diameter steel wire, typically 0.020", is placed in groove 37 and extends completely around the perimeter of opening 36 except for the overlapping pawl portion 38. The ring diameter is slightly smaller than the outer diameter of groove 37 so as to extend inward sufficiently to engage the peripheral groove 20 on socket 10 and maintain the socket and handle in easily releasable engagement.

A generally round pawl 40 is received within the pawl portion 38 of opening 34, and as illustrated in FIGS. 5 and 6, is supported for rotation about a pawl axis B, that is spaced from and parallel to the rotational axis A of a socket 10 received in the circular portion 36 of the opening. Pawl 40 has two spaced sets of teeth 40A and 40B that selectively engage the teeth 20 of a socket 10 for preventing rotation of the socket relative to the wrench head in one direction or the other depending upon the position of the pawl. The direction of locking of the socket against rotation is controlled by thumb movement applied to an integral tab 42 on the pawl 40 to rotate it about axis B and thereby engage the socket teeth with one or the other of pawl teeth 40A or 40B. Engagement of pawl teeth 40A and 40B with the socket teeth 20 is maintained by a spring biaser 44, to be described presently.

Being of the same length as the thickness of the wrench head, the teeth 18 of an engaged socket extend continuously without interruption (except for the narrow groove 20) between the opposing planar surfaces of the wrench head, as do the pawl teeth 40A and 40B, there is uninterrupted engagement of these tooth surfaces when the pawl 40 positioned to provide locking of the socket 10 in one direction and ratcheting thereof in the other direction. This permits a thin wrench to apply a relatively large amount of torque to the toothed peripheral surface of a socket. The thin wrench construction, coupled with the inventive thin-walled hollow socket, enables the wrench and socket system to be manufactured with less material than conventional ratchet wrench systems and at far less cost.

As shown in FIGS. 5 and 6, pawl 40 has a pair of positioning surfaces 46, 48 against which spring biaser 44 acts to provide overcenter positioning of the pawl to engage either pawl teeth 40A or pawl teeth 40B with the socket teeth 18. As seen in FIG. 4, pawl 40 has spaced skirts 50 and 52 between which the positioning surfaces 46 and 48 are located; each positioning surface is flat and defines an associated notch between the spaced skirts 50 and 52.

The spring biaser 44 includes a ball 60 and a helical compression spring 62 that biases the ball against the notches of pawl 40 to provide the overcenter positioning of the pawl. One end of spring 62 is seated in a hole 64 that extends from the pawl portion 38 of opening 34 toward the handle of the wrench, and ball 60 is seated at the other end of the spring to provide biasing of pawl 40.

In FIG. 5, the pawl teeth 40A are engaged with the socket teeth 18 so as to prevent socket rotation in a counterclockwise direction with respect to wrench head 26, while permitting movement of the socket 10 in a clockwise direction by the pawl teeth 40A ratcheting over the socket teeth 18, as shown in FIG. 6. Deflection of spring biaser 44 allows such ratcheting and permits back and forth stroking of wrench handle 28 without disengagement from the associated socket or from the nut being rotated. Movement of the pawl to the position shown in FIG. 6 initially disengages pawl teeth 40A from the socket teeth 18 and then causes pawl teeth 40B to engage the socket teeth and prevent clockwise rotation of socket 10 with respect to the wrench head 26 while permitting ratcheting in the counterclockwise direction.

The head 26 and handle 28 are made integral with each other, preferably by a stamping operation, and the socket 10 (and others of a set) are preferably made by cold-forging in a one-shot operation.

Figure 7:
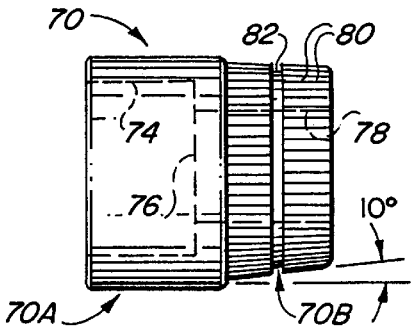
Figure 7B:
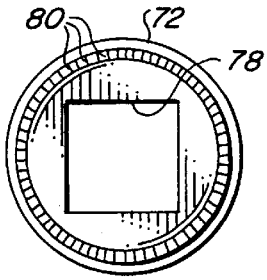

FIGS. 7, 7A and 7B are side, left end and right end views, respectively, of a socket 70 which embodies the invention but differs from the socket shown in FIG. 2 in a design aspect that makes it easier to cold-forge. In this variation, a first body portion 70A of the socket is circular cylindrical and has a hexagonal nut-receiving opening 74 which extends inwardly from its free end and is bottomed at an integral, relatively thin, transverse wall 76. A square axial opening 78 extends inwardly from the free end of a second body portion 70B to and through transverse wall 76 to connect with the nut-receiving opening. The otherwise cylindrical second body portion 70B tapers toward its free end and has a multiplicity of teeth 80 uniformly distributed therearound. Typically, the second body portion 70B has a taper of 10° with respect to its axis, has thirty-six teeth, each subtending a 90° angle, and at mid-length has a shallow peripheral groove 82 which serves as a detent for engaging a "C"-shaped wire ring in a wrench head for maintaining the socket and wrench in releasable engagement. The taper of the toothed second body portion makes cold forging easier in that it enhances release from the mold and promotes filling of the mold grooves that define the teeth. While the modified socket can be driven by the described wrench without modification, tapering of the wrench head opening 36, as well as the pawl teeth 40A and 40B, would improve its performance.

Figure 8A:
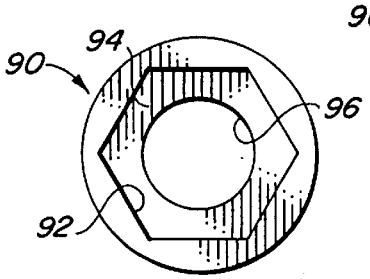
FIGS. 8, 8A and 8B are side, left end and right end views, respectively, of a socket constructed in accordance with second embodiment of the invention.
Figure 8:
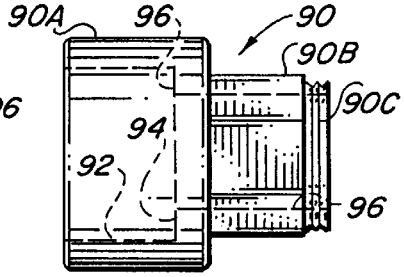
Figure 8B:
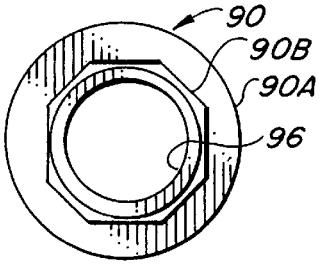

FIGS. 8, 8A and 8B illustrate a socket 90 which embodies the inventive feature of applying rotational torque to an exterior peripheral surface, but which differs from the previously described embodiments primarily in the characteristics of the peripheral surface. This socket, which also may be manufactured using a one-step cold forging operation, has a first circular cylindrical body portion 90A having a hexagonal nut-receiving opening 92 which extends inwardly from its free end, to an integral relatively thin transverse wall 94. A second body portion 90B, integral and collinear with body portion 90A, is hexagonal in shape and has a circular axial opening 96 which extends inwardly from the free end thereof to and through transverse wall 94. Second body portion 90B has a round collinear extension 90C, typically ⅛-inch long, and is provided with shallow grooves which mate with a rubber washer in an associated wrench (to be described) for maintaining the socket in releasable engagement with the wrench. In keeping with the design tenets of the previously described sockets, the diameter of axial opening 96 is large enough to allow passage of a bolt on which a nut engaged by the nut-receiving opening 92 is threaded. This feature not only enhances the versatility of the wrench, it results in a socket wall much thinner than that of conventional sockets with attendant reduction in the amount of material required for its manufacture.

Figure 9:
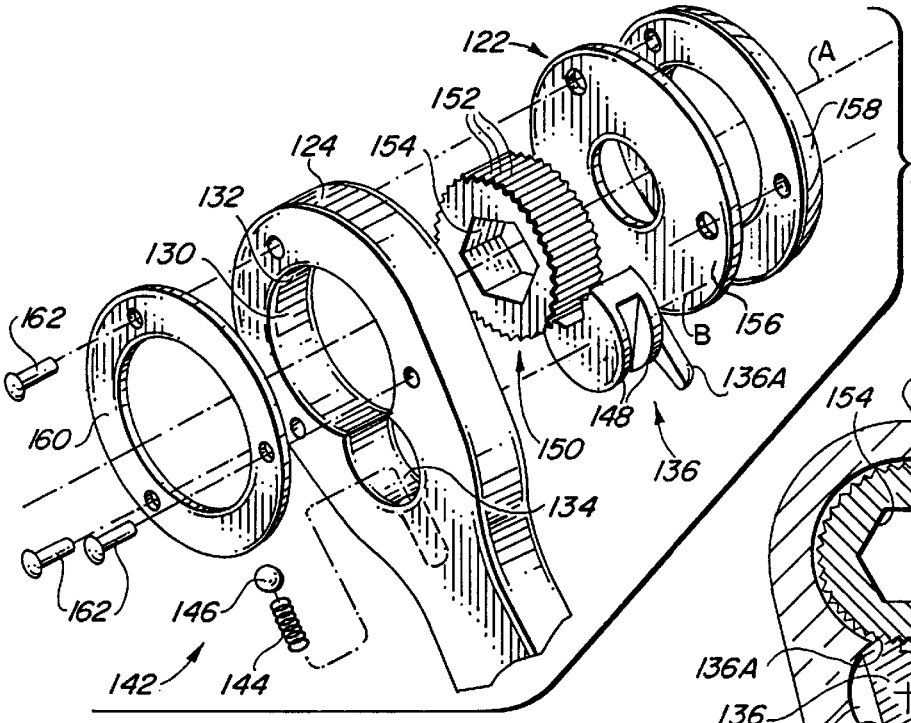
FIG. 9 is an exploded perspective view of a wrench head for use with the socket shown in FIGS. 8, 8A and 8B.
Figure 10:
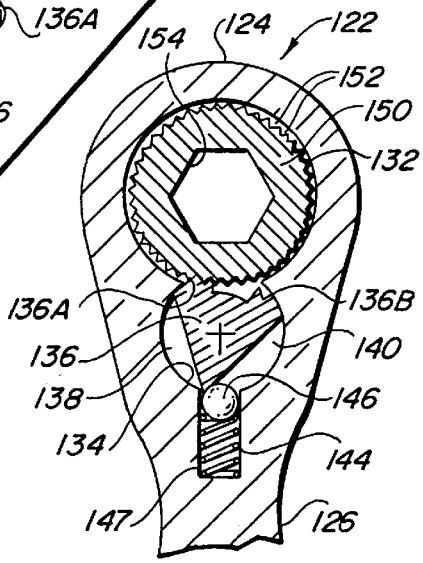
FIG. 10 is a sectional view showing the wrench of FIG. 9 locked against rotation in one direction but free to ratchet in the other direction.
Figure 12G:
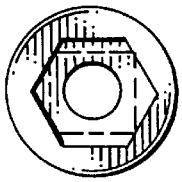
FIG. 12G (PRIOR ART)
Figure 12H:
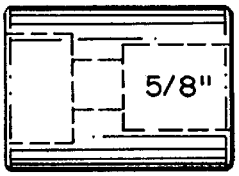
FIG. 12H (PRIOR ART)
Figure 12I:
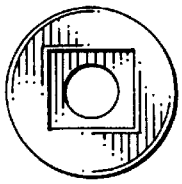
FIG. 12I (PRIOR ART)
Figure 12J:
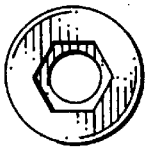
FIG. 12J (PRIOR ART)
FIGS. 12J, 12K and 12L are left end, side and right end views, respectively, of a fourth size of a typical prior art socket.
Figure 12K:
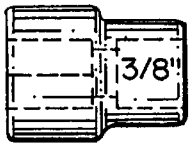
FIG. 12K (PRIOR ART)
Figure 12L:
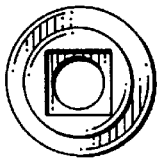
FIG. 12L (PRIOR ART)

FIGS. 9 and 10 illustrate a reversible ratchet wrench 122 for use with the socket shown in FIGS. 8, 8A and 8B, this also being an adaptation of the ratchet wrench disclosed in U.S. Pat. No. 4,631,988, and having some features common to the wrench shown in FIGS. 1, 3, 4, 5 and 6. The wrench includes a head 124 with opposing parallel planar surfaces which define its thickness, and a handle 126 integral with and extending from the head. Wrench head 124 has an opening 130 extending between the opposing surfaces which includes a circular driver opening 132 and a circular pawl opening 134 that slightly overlaps portion 132.

A generally round pawl 136 is supported within opening 134 for rotation about a pawl axis B, and has two spaced sets of teeth 136A and 136B that extend slightly into driver opening 132 at selected rotational positions of pawl 136. Pawl 136 includes a pair of positioning surfaces 138, 140 against which a spring biaser 142, which includes a helical spring 144 seated in cylindrical hole 147, and a ball 146 acts to provide overcenter positioning of the pawl to cause projection of one or the other of pawl teeth 136A or 136B into circular opening 130. As seen in FIG. 9, pawl 136 has spaced skirts 148 between which the positioning surfaces 138 and 140 are located. Each positioning surface is flat and defines an associated notch between the spaced skirts.

The wrench includes a driver 150 having a round cylindrical ratchet portion sized to be received within circular driver portion 132 of opening 130 and supported for rotation about a driver axis A spaced from and parallel to pawl axis B. Teeth 152 on the ratchet portion are disposed parallel to and are distributed about the rotational axis A of the driver.

Driver 150 has an axial length substantially equal to the length of the hexagonal second body portion 90B of the socket shown in FIG. 8, and has a hexagonal axial opening 154 therethrough dimensioned to receive and engage the hexagonal second body portion 90B to provide driving connection of the driver to the outer periphery of the socket.

Associated with driver 150 is an annular washer 156 formed of a resilient material, such as hard rubber, having an outer diameter approximating the outer diameter of head 124 and an inner diameter dimensioned to encroach onto hexagonal opening 154 to an extent sufficient to engage the grooved round extension 90C of body portion 90B and maintain it in easily releasable frictional engagement with the driver. Driver 150 is retained within opening portion 132 of wrench head 124, and washer 156 is held against one planar surface of the wrench head, with two retainers: an annular dome-shaped retaining cap 158 having inner and outer diameters generally corresponding to the inner and outer diameters, respectively, of washer 156 and a height corresponding to the thickness of the washer, and a retainer washer 160 having an outer diameter corresponding to the outer diameter of wrench head 124 and an inner diameter dimensioned to circumscribe the hexagonal opening 154. The two retainers are maintained in fixed relationship by suitable fastening means, such as the three rivets 162, that extend through respective circumferentially spaced aligned openings that extend through washer 160, wrench head 124, washer 156 and cap 158 and are secured by peening their ends, for example.

The generally round pawl 136 includes a thumb-actuable tab 136A by which a user can rotate the pawl about axis B and thereby selectively engage the pawl teeth 136A and 136B with the ratchet teeth 152 in order to change the direction of locking of the driver against rotation. Pawl teeth 136A or 136B are maintained in engagement with the teeth 152 on the driver by a spring biaser 144 having the same construction as the spring biaser of the FIG. 4 wrench; as its operation is identical, to here repeat its description would be superfluous.

FIG. 11 illustrates the important operational advantage of the socket wrench over conventional systems resulting from application of rotational torque to the peripheral teeth of the socket. External application of torque allows for an axial extension of the nut-receiving opening that is sufficiently large to allow a bolt 170 engaged by a nut of a size corresponding to the nut-receiving opening of socket 172 to pass through the opening and extend beyond the nut, and the wrench head 174 should operational circumstances require. This advantage is realized by all of the described sockets and obtains whether the axial opening is circular or square. A square axial opening sized to receive the largest possible standard-sized conventional driving lug provides the further advantage that it can be driven by a drive lug fitted to an extension of a conventional ratchet wrench to enable loosening or tightening of a nut or bolt head that may not be reachable with the present wrench.

For purposes of showing the size and weight advantage the improved socket has over conventional prior art sockets, FIGS. 12A through 12L illustrate four different-sized sockets of a prior art set, and FIGS. 13A through 13L shows four sockets of the same size constructed in accordance with the present invention. As mentioned in the introduction, a standard ¾-inch socket 200 has a cylindrical body having a one-inch outside diameter, an overall length of 1½ inches, a ½-inch deep 6-point nut-receiving opening 202 at one end, and a ½-inch square drive opening 204 which extends ⅝-inch inwardly from the other end to a transverse wall at which the square opening becomes circular and smaller, 7/16-inch in diameter. The typical socket weighs two ounces.

A standard ⅞-inch socket from the same prior art graduated set is also cylindrical and 1½-inches long, but is 1 3/16 inches in diameter, has a 11/16-inch deep nut-receiving opening, a ½-inch square and 9/16-deep drive opening and a 5/16-inch long and ⅝-inch diameter circular opening connecting the drive opening to the nut-receiving opening, and weighs in excess of two ounces.

The illustrated standard ⅝-inch 6-point socket is ⅞-inch in diameter, has a ⅜-inch deep nut-receiving opening, and a ½-inch square and ⅝-inch deep drive opening connected to the nut-receiving opening by a ¼-inch long, 5/16-inch diameter, circular opening.

The ⅜-inch socket is ⅞-inch long, is 11/16-inch in diameter for a half-inch of its length and 9/16-inch in diameter for the balance. Its ½-inch deep nut-receiving opening is connected to a ⅜-inch square and 5/16-inch deep drive opening by a ⅛-inch long, ⅜-inch diameter circular opening.

Referring to FIGS. 13A through 13L, while the illustrated four sockets of a set constructed in accordance with the present invention have nut-receiving openings of the same sizes as the correspondingly sized standard sockets, they differ in the important respects that all are appreciably shorter and have nut-receiving openings differing little in depth, ranging from 7/16-inch for the largest to 5/16-inch for the smallest, all bottomed by a ⅛-inch thick transverse wall. The outside diameters of a first body portion at the left end of the three largest sockets are 1 3/16-inches, 1-inch and ⅞-inch, respectively, and each has a pair of opposed flats disposed parallel to respective opposed flat sides of the hexagonal nut-receiving openings. A first body portion at the left end of the ⅜-inch socket has the same hexagonal shape as the nut-receiving opening, but is sufficiently larger as to provide sidewalls approximately 1/16-inch thick.

At their other end, all of the sockets of the set have a circular cylindrical second body portion of the same length and diameter, typically 5/16-inch and ⅞-inch, respectively, to match the thickness of the wrench head and the diameter of the socket portion of the wrench head opening of the reversible ratchet wrench shown in FIG. 4, around which a multiplicity of teeth are distributed. The three largest sockets each has a ½inch square opening, and the ⅜-inch socket has a ⅜-inch square opening, that extends axially from the free end to and through the transverse wall to connect with the nut-receiving opening. The large size of the axial opening relative to the outside diameter of the second body portion, and the large size of the nut-receiving opening relative to the outside diameter of the first body portion dramatically reduce the wall thickness of the socket. Also, as has been noted earlier, a large square axial opening serves the dual functions of allowing a bolt engaged by a socket-size nut to pass through the opening and of providing a drive opening for receiving the driving lug of a conventional ratchet wrench. The ¾-inch socket weighs half as much as its prior art counterpart—one ounce versus two—and the other sizes of a set likewise weigh about half as much as correspondingly-sized prior art sockets, yet exceeds ANSI specifications for wear and durability. This represents a fifty percent reduction in the amount of material, typically tool steel, required to fabricate the sockets. Also, a less powerful forging press is needed to cold-forge the less bulky, thinner walled product, further reducing the manufacturing cost. Not to be overlooked is the approximately 50% reduction in the weight of the user's toolbox.

While all of the described variations of the improved socket are preferably made in one piece, with one stroke of a cold-forging press, they may instead be fabricated by forging two complementary parts and permanently joining them together, as by welding. As shown in FIG. 14, a ⅞-inch socket having the properties described in connection with FIGS. 13A, 13B and 13C may comprise a hollow cylindrical first body portion 210 having a hexagonally-shaped outer surface and a circular cylindrical inner surface 212 having the same diameter as a cylindrical second body portion 214 that fits into body portion 210. That portion of the length of second body portion 214 that extends from body portion 210 has teeth distributed therearound, and has a square axial opening 216 which extends inwardly from the left end, through a transverse wall 218. The two portions 210 and 214 may be soldered, welded or otherwise permanently joined together.

Referring to FIG. 15, the construction of the ¾-inch socket is generally similar, but because the first and second body portions have the same outside diameters, the second body portion is rabbeted along its inner edge and fitted into the first body portion to form a secure and smooth joint.

As seen in FIG. 16, because the outside diameter of the toothed second body portion of the ⅝-inch socket is larger than that of the first body portion, the inner end of the second body portion has a deep rabbet along its inner edge to allow it to fit into the cylindrical opening in the first body portion to form a tight joint. The second body portion has a peripheral rim located at the inner end of the teeth for limiting the extent to which the second body portion may enter the circular socket in the wrench head illustrated in FIG. 4.

Figure 13A:
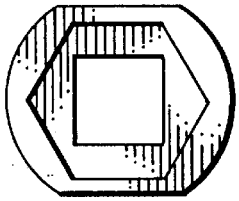
FIGS. 13A, 13B and 13C are left end, side and right end views, respectively, of a socket of the size of that depicted in FIGS. 12A, 12B and 12C, but constructed in accordance with he present invention.
Figure 13B:
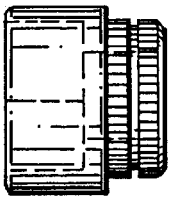
Figure 13C:
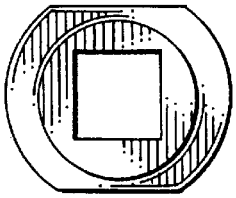
Figure 13D:
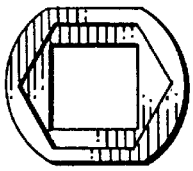
FIGS. 13D, 13E and 13F are left end, side and right end views, respectively, of a socket of the size of that depicted in FIGS. 12D, 12E and 12F, but constructed in accordance with the present invention.
Figure 13E:
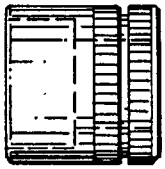
Figure 13F:
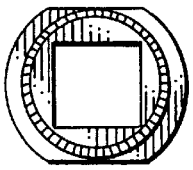
Figure 13G:
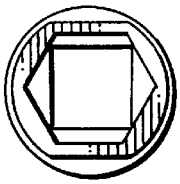
FIGS. 13G, 13H and 13I are left end, side and right end views, respectively, of a socket of the size of that depicted in FIGS. 12G, 12H and 12I, but constructed in accordance with the present invention.
Figure 13H:
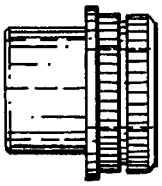
Figure 13I:
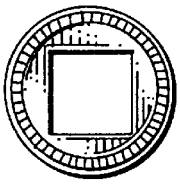
Figure 13J:
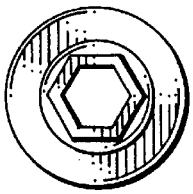
FIGS. 13J, 13K and 13L are left end, side and right end views, respectively, of a socket of the size of that depicted in FIGS. 12J, 12K and 12L, but constructed in accordance with the present invention.
Figure 13K:
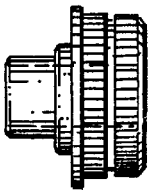
Figure 13L:
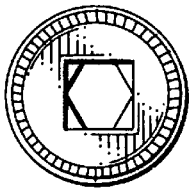

The cylindrical toothed second body portion of the ⅜-inch socket shown in FIG. 17 also has a peripheral rim 220 at the inner end of the teeth, and at its inner end has an integral rim 222 which extends inwardly from rim 220 and is shaped to be joined with the inner end of a thin-walled hexagonal body portion 224 corresponding to that shown in FIGS. 13J, 13K and 13L.

While the best mode for carrying out the invention has been described in detail, it will now be evident to those familiar with the art to which this invention relates that various changes may be made in the invention without departing from the spirit and scope thereof. Therefore, the invention is not limited by that which is shown in the drawings and described in the specification, but only as indicated in the appended claims.

I claim:

1. A light-weight socket wrench system comprising the combination of a thin-walled socket having a nut-receiving opening for engaging a nut or the head of a bolt, and a ratchet wrench adapted to releasably engage a peripheral surface of the socket for tightening or loosening a nut threaded on a bolt or a bolt head, wherein said socket wrench system comprises:

a socket comprising an elongate cylindrical body having collinearly adjacent first and second body portions, said first body portion having a standard-size nut receiving opening extending inward from a free end thereof to a depth determined by an interior transverse wall spaced from said free end, said second body portion having an axial opening extending coaxially inward from a free end thereof to and through said transverse wall to connect to said nut-receiving opening, said axial opening being sufficiently large to allow a bolt engaged by a nut of a size corresponding to that of said nut-receiving opening to pass through said axial opening and extend beyond the socket, said second body portion having a multiplicity of gear-like teeth disposed parallel to said axial opening and distributed around the periphery thereof and a circumferential groove in a surface thereof, and wherein said ratchet wrench comprises:

a wrench body including a head and an integral handle extending from the head, said head having a thickness defined by opposing planar surfaces corresponding to the length of the second body portion of the socket and includes an opening extending between the opposing surfaces, said opening having a circular portion which has a diameter substantially corresponding to an outer diameter of said second body portion of said socket and a pawl portion that partially overlaps the circular portion, both portions of said opening having cylindrical walls; and resilient spring means supported in a circumferential groove in the wall of the circular portion of said opening at a location along its length at which it directly engages said circumferential groove on the second body portion of a socket received in the circular portion of said opening for maintaining the socket in easily releasable operative engagement with the ratchet wrench; and a pawl supported within said pawl portion of the opening for rotation about a pawl axis, said pawl having spaced teeth that engage the teeth on the second body portion of a socket received within the circular portion of said opening for selectively preventing rotation of the socket relative to the head in one direction or the other depending on the pawl position; and a spring biaser for urging the pawl teeth toward the circular portion of the opening and into engagement with the teeth on the second body portion of said socket.

2. A socket wrench system as defined in claim 1, wherein said resilient spring means is a C-shaped spring formed of small diameter wire supported in a circumferential groove in the cylindrical wall of said circular portion, said C-shaped wire spring having a diameter smaller than the outer diameter of the circumferential groove in said cylindrical wall so as to extend inward sufficiently to engage the circumferential groove in the peripheral surface of the second body portion of a socket received in the circular portion of said spring.

3. A socket wrench system as defined in claim 2, wherein said wrench head has a thickness substantially corresponding to the length of the teeth on said second body portion of said socket, and wherein the circumferential groove in the peripheral surface of the second body portion of said socket is located substantially mid-length of said teeth.

4. A socket wrench system as defined in claim 1, wherein the peripheral surface of the second body portion of said socket is tapered toward the free end thereof.

5. A socket wrench system as defined in claim 1, wherein the teeth on the peripheral surface of the second body portion of said socket are substantially the same length as said second body portion.

6. A socket wrench system as defined in claim 1, wherein the axial opening in said second body portion is square in cross-section and sized to receive a standard-size driving lug of a conventional ratchet wrench.

7. A socket wrench system as defined in claim 1, wherein said socket is one of a set of sockets graduated according to size of the nut-receiving opening, and wherein all sockets of the set have second body portions of substantially the same length and outside diameter.

8. A socket wrench system as defined in claim 7, wherein the peripheral surface of the second body portion of all sockets of the set is tapered toward the free end thereof.

9. A ratchet wrench system comprising, in combination:

a wrench body including a head and an integral handle extending from the head, said head having upper and lower faces and an opening extending through said head between the upper face and the lower face, said opening having a circular portion and a pawl portion that partially overlaps the circular portion, and having retaining means supported in the circular portion;

pawl means supported within the pawl portion of said opening and including teeth extending into the circular portion of said opening:

a socket comprising a cylindrical body having a first portion and an integral collinear second portion, said first portion having an outer diameter substantially corresponding to the diameter of the circular portion of said opening and a length substantially corresponding to that of said opening adapted to be received therein, said first portion having a plurality of gear teeth distributed around its periphery cooperating with the teeth of said pawl means and engaging means in a surface thereof, and said second portion having an axial opening therein having surfaces for engaging a fastener of a predetermined size; and wherein said retaining means is supported in said circular portion at a location to engage and cooperate with the engaging means on the first portion of a socket received in said opening for maintaining the socket in operative engagement with the wrench while permitting its easy removal from said opening;

whereby a plurality of sockets all having like first portions and each having an axial opening in the second portion dimensioned to engage fasteners of different predetermined sizes may easily be interchangeably inserted in and removed from the opening through the wrench head.

10. A low-profile ratchet wrench as defined in claim 9, wherein the first portion of said socket has an axial opening formed therein connected to the axial opening in said second portion to form an axial through hole in the socket sufficiently large to allow a threaded shaft engaged by the fastener to pass therethrough and extend beyond the socket.

11. A ratchet wrench system as defined in claim 9, wherein said retaining means is a resilient wire spring ring supported in a circumferential groove in a wall of the circular portion of the opening through the head of said wrench.

12. A socket wrench system comprising, in combination, a ratchet wrench having a head with a circular opening therethrough for receiving a selected one of a plurality of interchangeable cylindrical wrench sockets, each of which is adapted to be removably retained in the circular opening by resilient means disposed in the circular opening in said head coacting with an external groove formed in each of the wrench sockets at a location to be engaged by said resilient means when a first portion of a socket is received in said opening for maintaining a socket in operative combination with a ratchet wrench while permitting its easy removal from the wrench thereby making the sockets quickly and easily interchangeable, said first portion of each socket having thereon a multiplicity of fine-pitch gear teeth distributed around the periphery thereof arranged to be directly engaged by a pawl mechanism supported in the wrench head in communication with said circular openings.

13. A ratchet wrench assembly including a socket to rotate a fastener comprising a plurality of cylindrical sockets each having a first portion of like diameter and length for engagement with a wrench and a second portion for engaging the fastener, the sockets each having an axial opening therethrough for allowing the sockets to engage the fastener when an object extends from the fastener by permitting the object to extend into and through the axial opening, a multiplicity of gear-like teeth distributed around the peripheral surface of said first portion and a circumferential groove formed in the peripheral surface of said first portion; wherein said wrench comprises:

a wrench body including a head and an integral handle extending from the head, said head having opposing planar surfaces and a thickness substantially corresponding to the length of the first portion of said sockets and includes an opening extending between the opposing surfaces, said opening having a circular portion which has a diameter substantially corresponding to the outer diameter of the first portion of said sockets and a circular pawl portion that partially overlaps the circular portion, both portions of said opening having cylindrical walls, and a resilient spring ring supported in a circumferential groove in the wall of the circular portion of said opening at a location thereon at which it directly engages the circumferential groove in the peripheral surface of the first portion of a socket received in said circular portion of said opening for maintaining the socket in operative engagement with the wrench while permitting its easy removal from said opening; and pawl means supported within the pawl portion of said opening for rotation about a pawl axis parallel to the axis of the circular portion of the opening and including spaced teeth which extend into the circular portion of said opening and directly engage the gear-like teeth on the peripheral surface of a socket received within the circular portion of said opening for selectively preventing rotation of a socket relative to the head in one direction or the other depending on the pawl position.

14. For use in a ratchet wrench assembly including a socket to rotate a fastener and a ratchet handle having a pawl mechanism, a socket comprising:

an elongate cylindrical body having collinearly adjacent first and second body portions, said first body portion for engagement with a ratchet handle and said second portion for engaging the fastener, said body having an axial opening therethrough for allowing the socket to engage the fastener when an object extends from the fastener by permitting the object to extend into the axial opening;

a multiplicity of fine-pitch gear teeth distributed around the peripheral surface of said first body portion arranged to be engaged by the pawl mechanism of a ratchet handle for applying rotational torque directly to the external surface of said first body portion; and a circumferential groove formed in said first body portion defining a detent adapted to be engaged by resilient means in the ratchet handle for maintaining the socket and wrench in easily releasable engagement.

15. A socket as defined in claim 14, wherein the first body portion of the socket has thirty-two gear teeth distributed around its peripheral surface.

16. For use in a ratchet wrench assembly including a cylindrical hollow socket to rotate a fastener and a ratchet wrench, a ratchet wrench comprising:

a wrench body including a head and an integral handle extending from the head, said head having opposing planar surfaces and includes an opening extending between the opposing surfaces, said opening having a circular portion which has a diameter substantially corresponding to the outer diameter of a cylindrical socket to be received therein and a circular pawl portion, both portions of said opening having cylindrical walls;

pawl means supported within the pawl portion of said opening for rotation about a pawl axis parallel to the axis of the circular portion of said opening and including spaced apart teeth which extend into the circular portion of said opening adapted to directly engage a peripheral surface of a cylindrical socket received within the circular portion of said opening;

a circumferential groove formed in the wall of the circular portion of said opening; and a resilient spring ring supported in said circumferential groove adapted to engage the peripheral surface of a received socket for maintaining the socket and wrench in easily releasable engagement.

* * * * *